US006855000B2

(12) United States Patent
Wu

(10) Patent No.: US 6,855,000 B2
(45) Date of Patent: Feb. 15, 2005

(54) CABLE END CONNECTOR ASSEMBLY HAVING PULL TAB

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/604,356

(22) Filed: Jul. 14, 2003

(65) Prior Publication Data

US 2005/0014414 A1 Jan. 20, 2005

(51) Int. Cl.[7] ..... H01R 13/00
(52) U.S. Cl. ..... 439/484; 439/476.1
(58) Field of Search ..... 439/484, 483, 439/476.1

(56) References Cited

U.S. PATENT DOCUMENTS 4,379,361 A 4/1983 Webster et al.
4,881,911 A 11/1989 Haddock et al.
5,108,306 A * 4/1992 Wellinsky ..... 439/404
6,074,237 A 6/2000 Lee
6,126,479 A 10/2000 Lee
6,132,241 A 10/2000 Hwang
6,179,642 B1 * 1/2001 Hwang ..... 439/358
6,347,957 B1 * 2/2002 Hwqng ..... 439/459
6,416,353 B1 7/2002 Hwang et al.
6,500,023 B1 * 12/2002 Duong et al. ..... 439/484

* cited by examiner

*Primary Examiner*—Hae Moon Hyeon
(74) *Attorney, Agent, or Firm*—Wei Te Chung

(57) ABSTRACT

A cable end connector assembly (1) includes an insulative housing (2), a number of electrical contacts (6) received in the insulative housing, a cable (4) electrically terminated with the electrical contacts, a cover (3) assembled to the insulative housing, and a pull tab (5). The insulative housing includes a first wall (224) and a second wall (226) opposite to the first wall. Each of the first and the second walls forms a pair of protrusions (24) on a pair of ends thereof. Each protrusion defines a recess (240) therein. The pull tab is assembled to the insulative housing and includes a pulling section (50) and a pair of fastening sections (52). Each fastening section comprises a pair of branches (51) respectively received in the pair of recesses of the insulative housing.

18 Claims, 8 Drawing Sheets

CABLE END CONNECTOR ASSEMBLY HAVING PULL TAB

BACKGROUND OF INVENTION

1. Field of the Invention

The present invention generally relates to a cable end connector assembly, and more particularly to a cable end connector assembly having a pull tab.

2. Description of Related Art

It is well known that a cable end connector assembly comprises a cable end connector and a cable electrically terminated to the cable end connector. The cable end connector assembly is usually maable with a complementary connector for transmitting signals from the cable to the complementary connector.

However, a panel of a chassis to which the complementary connector is mounted may have so many components mounted thereon that an operator can only pull the cable of the cable end connector assembly to separate the cable end connector assembly from the complementary connector if there is no additional device. This may cause wires of the cable be divorced from contacts of the cable end connector, and thus, influences the signal transmission between the cable end connector assembly and the complementary connector inevitably. To solve this problem, different kinds of pull mechanisms are designed. For example, U.S. Pat. Nos. 4,379,361, 6,126,479 and 6,416,353 each discloses a pull tab or pull mechanism to solve the problem mentioned above.

U.S. Pat. No. 4,379,361 discloses a pull tab received in a housing of a cable termination assembly and having a plurality of openings for receiving respective deformed parts of signal conductors of a cable. This kind of pull tab is difficult to assemble to the cable termination assembly and the structure thereof is relatively complex.

U.S. Pat. No. 6,416,353 (the 353 patent) discloses an IDC (insulation Displacement Connection) connector assembly which comprises a housing, a cable terminated to contacts received in the housing, a first cover assembled to the housing and cable, and a second cover assembled to the first cover and the hous ing functioning as a pull mechanism for separating the connector assembly from a complementary connector. However, the occupied space of the second cover is relatively big for some special applications.

U.S. Pat. No. 6,126,479 discloses an IDC connector assembly which comprises an elongated housing containing a plurality of contacts therein, a cable electrically terminated to the contacts, an elongated cover assembled to the housing and the cable, and a flexible pull tab received in a slot defined between longitudinal sides of the cover. The elongated cover needs to have a relatively large height for ensuring rigidity thereof and for resisting a pulling force exerted on the pull tab, so it is still undesirable for some special circumstances.

Hence, a cable end connector assembly with an improved pull tab structure is needed to address the problems encountered in the related art.

SUMMARY OF INVENTION

An object of the present invention is to provide a cable end connector assembly having a pull tab for disengaging the cable end connector assembly from a complementary connector more conveniently.

Another object of the present invention is to provide a cable end connector assembly which is simple in structure and easy to manufacture In order to achieve the objects set forth, OLE_LINK3 a cable end connector assembly in accordance with the present invention comprises an insulative housing, a plurality of electrical contacts received in the insulative housing, a cable electrically terminated with the electrical contacts, a cover assembled to the housing for securely attaching the cable to the electrical contacts and a pull tab. The insulative housing comprises a first wall and a second wall opposite to the first wall. Each of the first and the second walls forms a pair of protrusions on a pair of ends thereof. Each protrusion defines a recess therein. The pull tab is assembled to the insulative housing and comprises a pulling section and a pair of fastening sections. Each fastening section of the pull tab comprises a pair of branches respectively received in the pair of recesses of the insulative housing.

Other objects, advantages and novel features of the invention will become more apparent from the following detailed description when taken in conjunction with the accompanying drawings.

DETAILED DESCRIPTION

Reference will now be made in detail to the preferred embodiment of the present invention.

Figure 1:
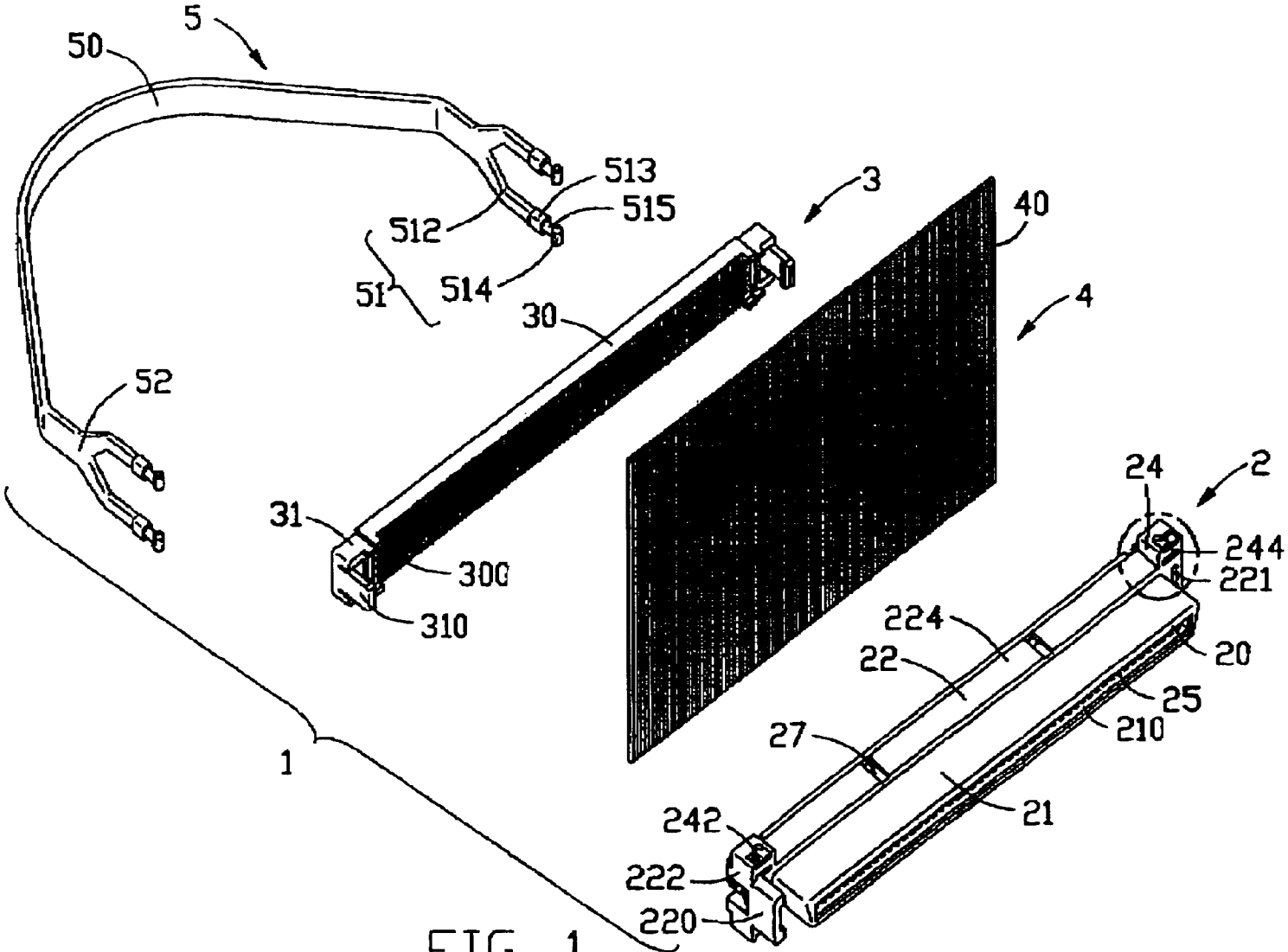
FIG. 1 is a partially exploded, perspective view of a cable end connector assembly in accordance with the present invention.
Figure 2:
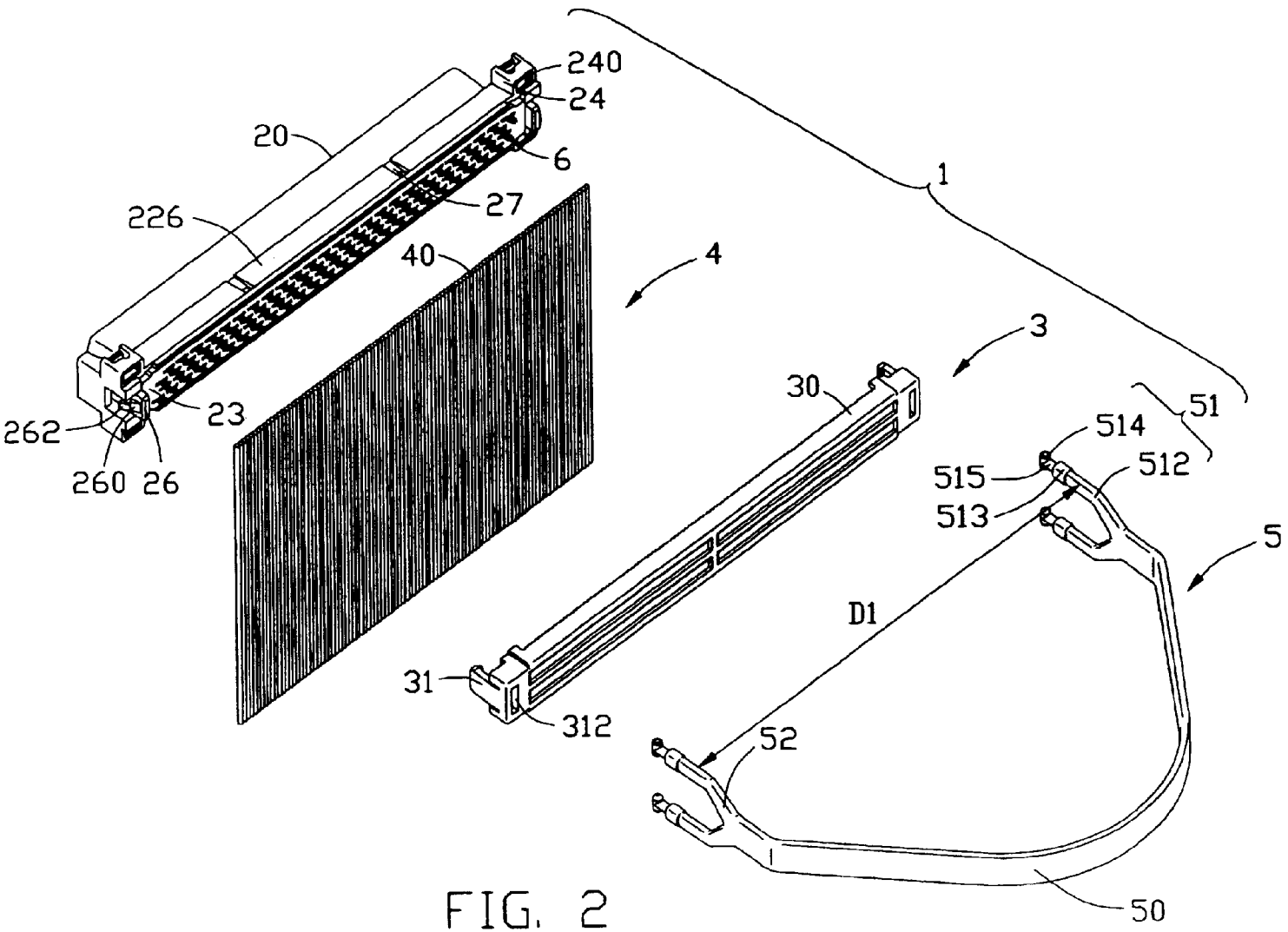
FIG. 2 is a view similar to FIG. 1, but taken from a different aspect.
Figure 3:
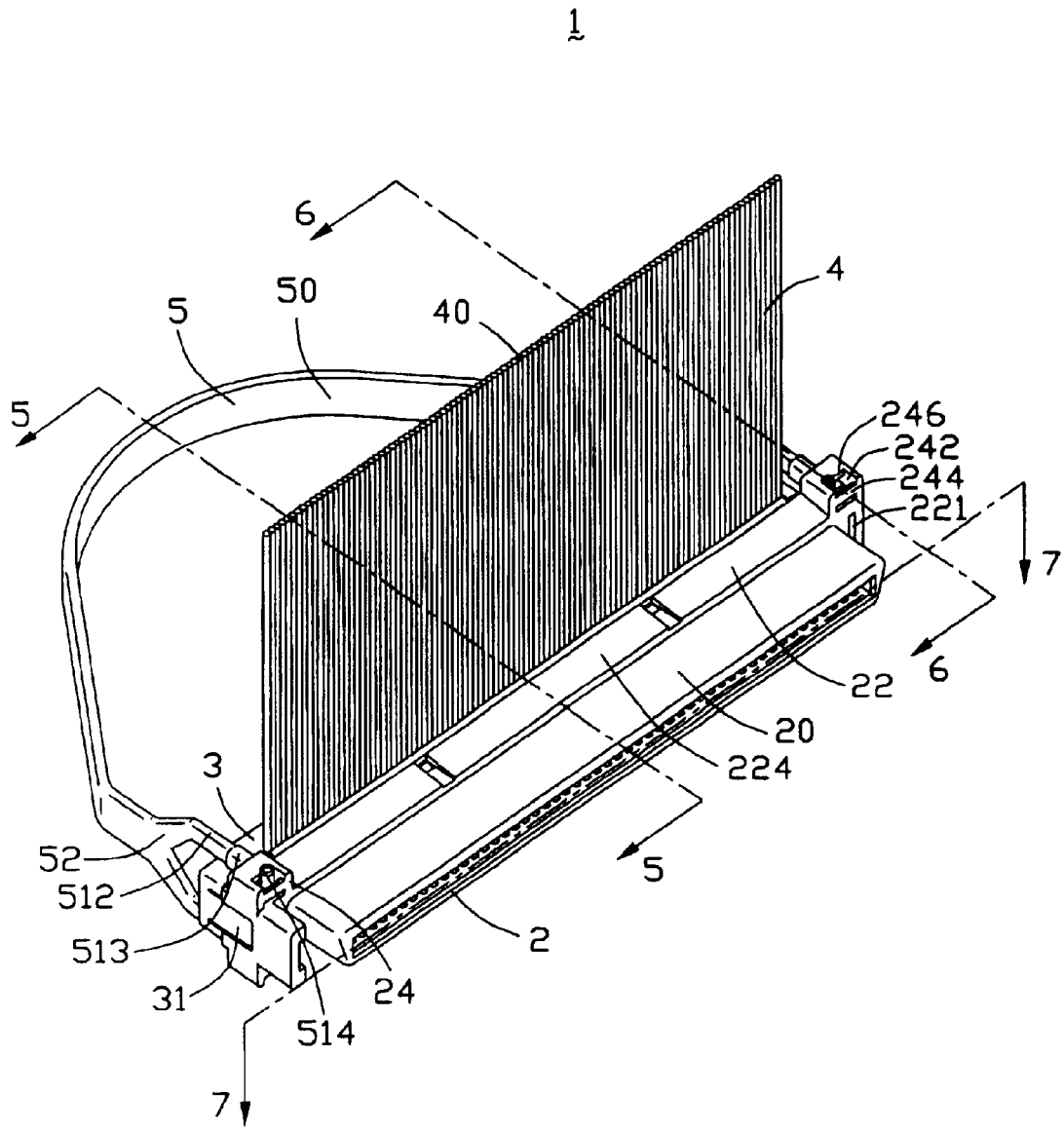
FIG. 3 is an assembled view of the cable end connector assembly of FIG. 1.
Figure 4:
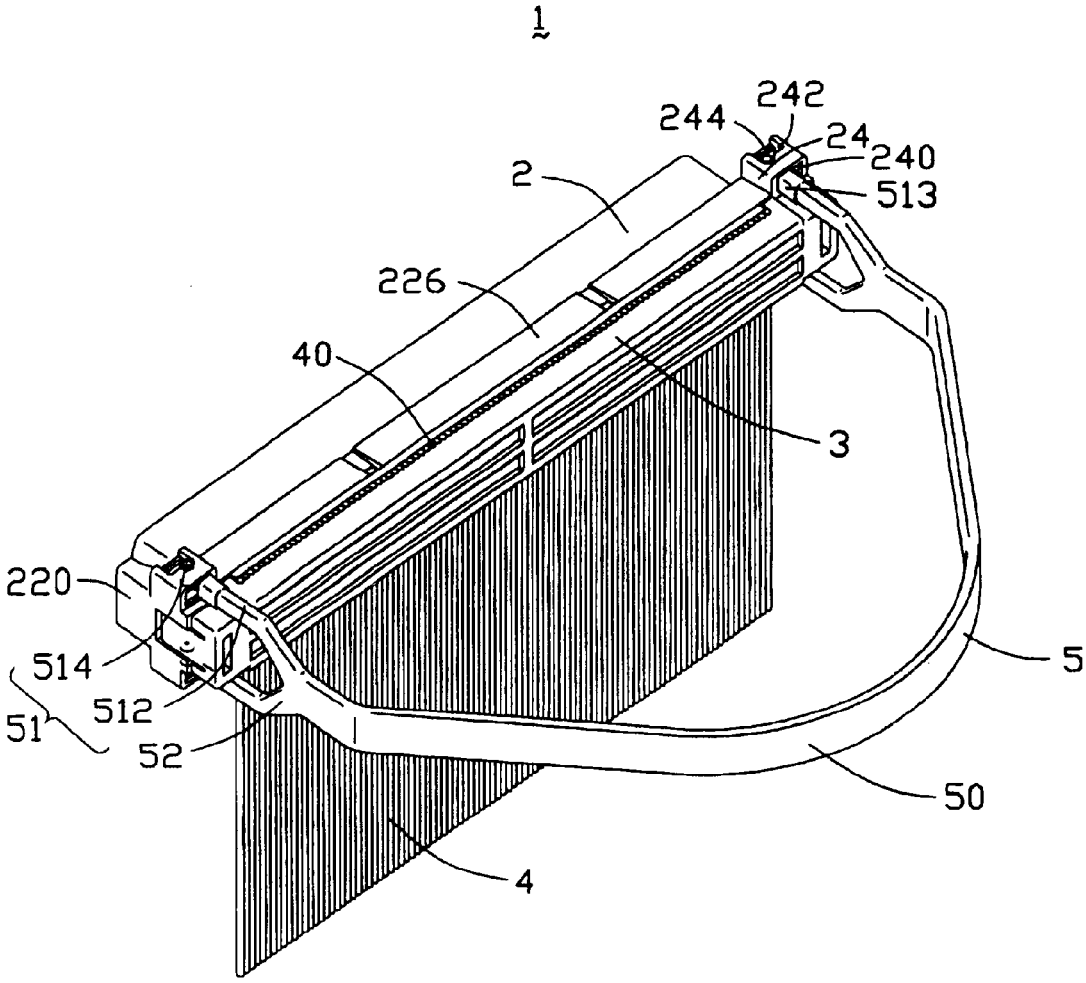
FIG. 4 is a view similar to FIG. 3, but taken from a different aspect.

Referring to FIG. 1 and FIG. 2, a cable end connector assembly 1 in accordance with the present invention comprises an elongated insulative housing 2, a plurality of electrical contacts 6 received in the insulative housing 2, an insulated cover 3 securely attached to the insulative housing 2, a cable 4 and a pull tab 5.

Figure 8:
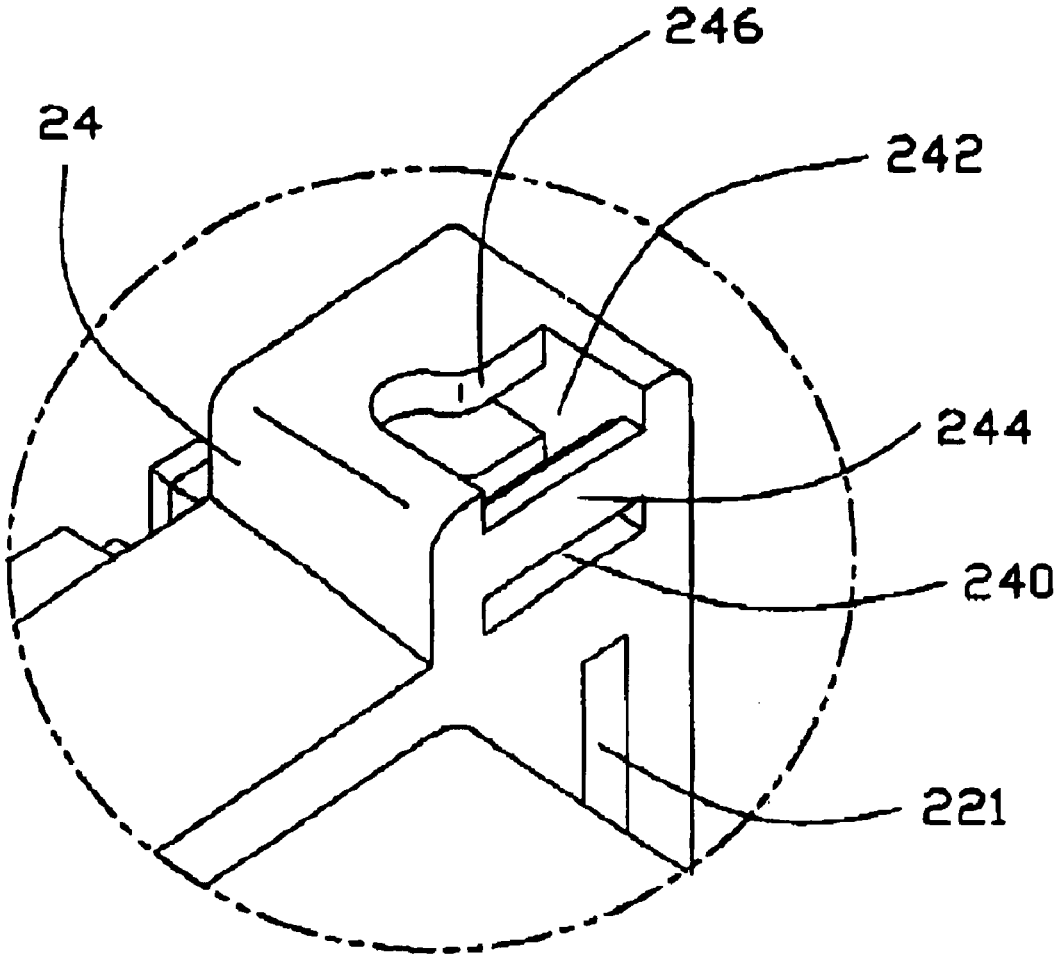
FIG. 8 is an enlarged view of a circular area of FIG. 1 showing detailedly the area of the protrusion including a recess, an opening and a rib.

Continuing to FIG. 1 and FIG. 2 in conjunction with FIG. 8, the insulative housing 2 comprises a base 22 and a D-shaped mating portion 21 protruding from a center of the base 22. The insulative housing 2 also comprises a mating face 20 and a termination face 23 opposite to the mating face 20. A pair of slits 221 is respectively defined in opposite lateral ends 222 of the base 22, and a transverse U-shaped guiding post 220 extends forwardly from one lateral end 222. A pair of engaging portions 26 extends outwardly from the pair of opposite lateral ends 222 of the base 22, respectively. Each engaging portion 26 is formed with a first and a second retaining wedges 260, 262. A pair of grooves 27 if respectively defined in opposite first and second walls 224, 226 of the base 22. A receiving space 210 is defined rearwardly from the mating face 20 of the insulative housing 2 to form a continuous periphery wall (not labeled). A plurality of passageways 25 is defined in the periphery wall of the insulative housing 2 and extends from the termination face 23 toward the mating face 20 of the insulative housing 2. A pair of rectangular protrusions 24 is formed on each lateral end 222 and extends oppositely from the opposite first and second walls 224, 226 of the insulative housing 2. A recess 240 extends through each protrusion 24 along a rear-to-front direction of the insulative housing 2. An opening 242 with a curved edge 246 is defined in each protrusion 24 to communicate with the recess 240. Each protrusion 24 also forms a rib 244 on a front surface thereof.

Figure 5:
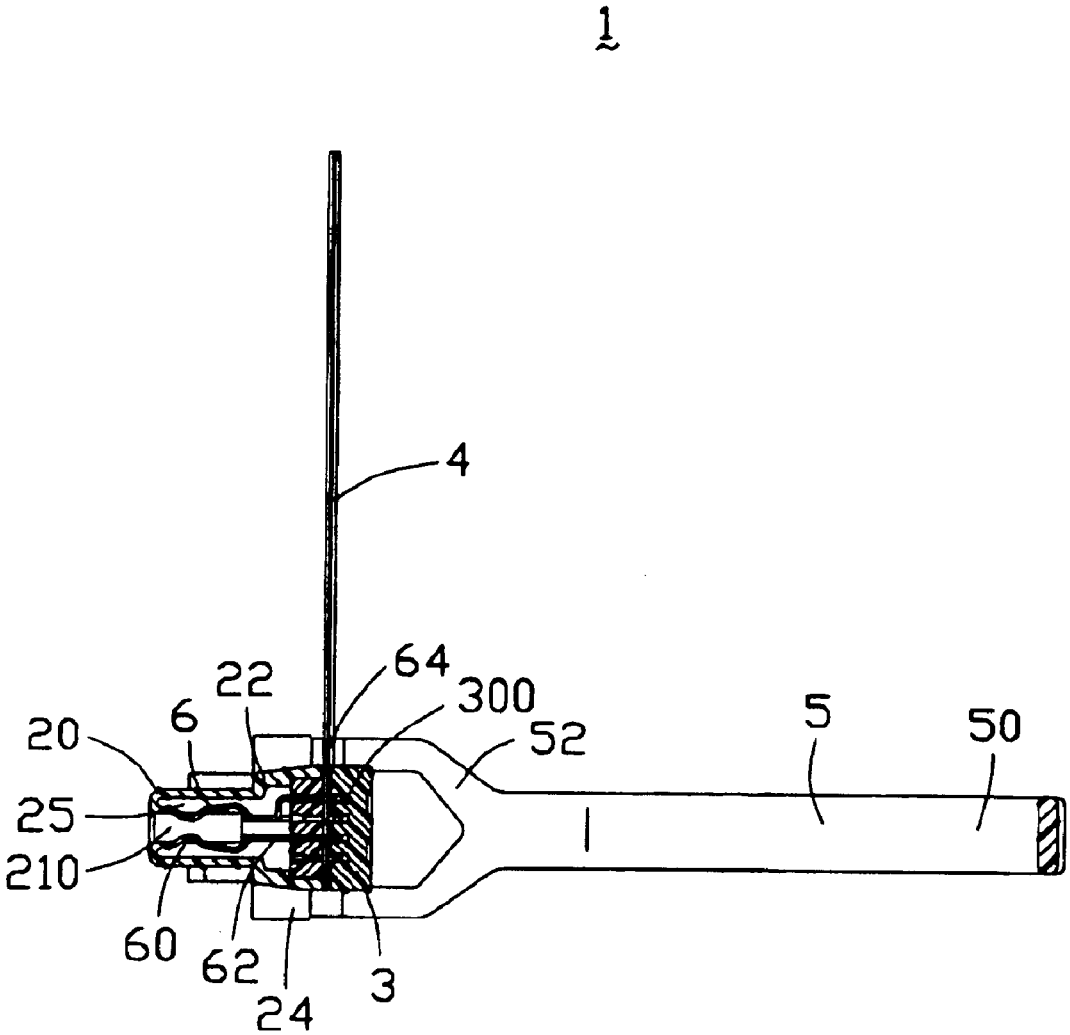
FIG. 5 is a cross-sectional view of the cable end connector assembly taken along line 5—5 of FIG. 3.
Figure 6:
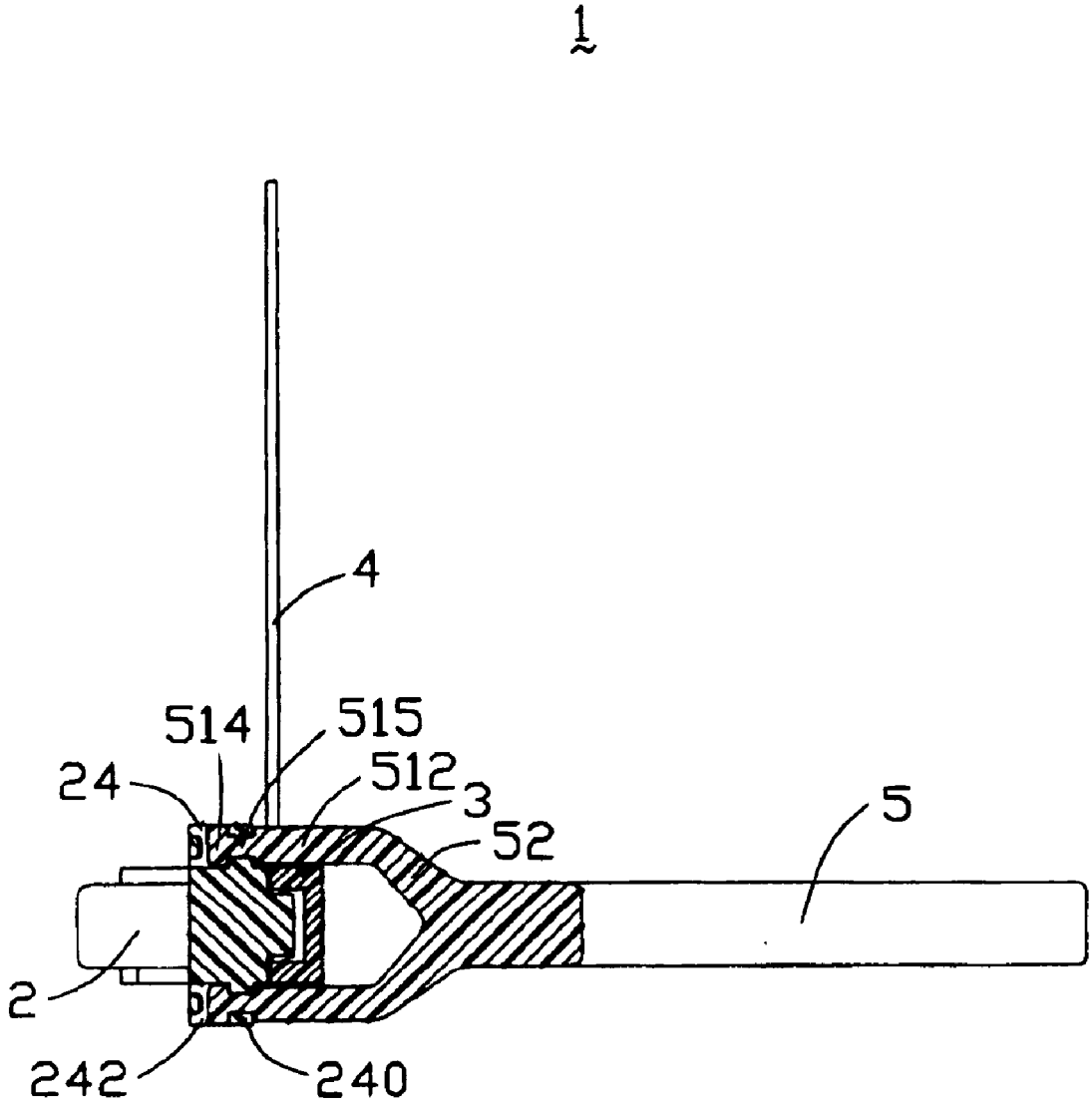
FIG. 6 is a cross-sectional view of the cable end connector assembly taken along line 6—6 of FIG. 3.

Together referring to FIG. 5, each of the electrical contacts 6 comprises a contacting portion 60 received in a corresponding passageway 25 of the insulative housing 2 for electrically connected to the complementary connector, an insulation displacement portion 64 opposite to the contacting portion 60 and exposed outside the termination face 23, and a retention portion 62 interconnecting the contacting portion 60 and the insulation displacement portion 64 and interfering with inner surfaces of the corresponding passageway 25.

Referring to FIGS. 1–2, the insulative cover 3 is made of insulative material such as plastic and comprises an elongated main body 30 and a pair of opposite ends 31 formed integrally with the main body 30. Each end 31 defines a slot 312 therethrough and forms a latch 310 extending outwardly along an outmost surface thereof. A plurality of grooves 300 is defined in a front face of the main body 30.

In the preferred embodiment, the cable 4 is in the form of a ribbon cable.

Continuing to FIGS. 1–2, the pull tab 5 is made of plastic material and is preferably flexible. The pull tab 5 comprises a substantially OLE_LINK7semiellipseOLE_LINK7-shape pulling section 50 and a pair of fastening sections 52 respectively extending from opposite free ends of the pulling section 50. Each fastening section 52 is of a fork shape and consists of a pair of spaced branches 51. The branch 51 comprises a column section 512 and a tip post 514 formed on a free end 515 of the column section 512. The tip post 514 extends along a direction perpendicular to a longitudinal axis of the column section 512. An annular stop section 513 protrudes outwardly from a periphery of the column section 512, and the free end 515 recesses inwardly from the periphery of the column section 512.

Figure 7:
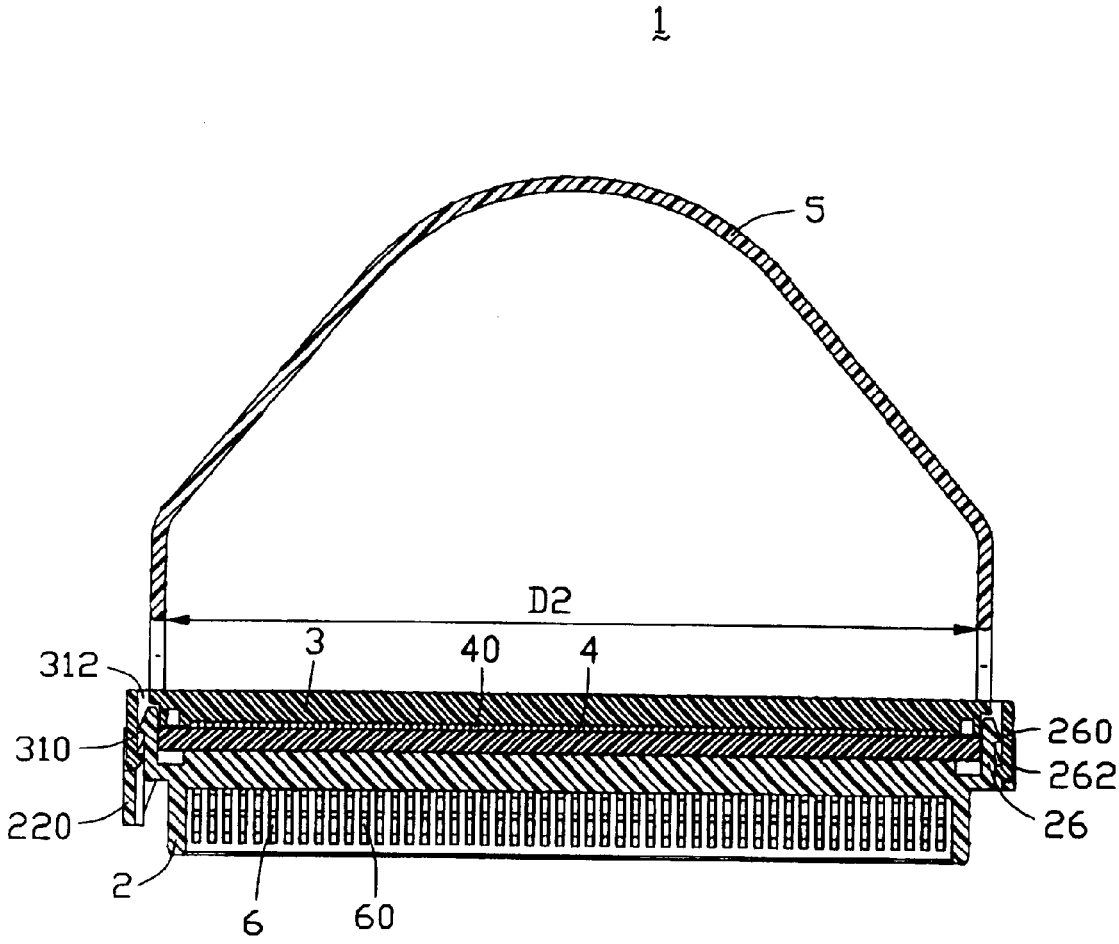
FIG. 7 is a cross-sectional view of the cable end connector assembly taken along line 7—7 of FIG. 3.

In assembly, referring to FIGS. 3–8 and in conjunction with FIGS. 1–2, the cable 4 is terminated to the termination face 23 of the insulative housing 2 with conductors 40 thereof electrically terminated with the insulation displacement portions 64 of the electrical contacts 6. The insulative cover 3 is secured to the insulative housing 2 for preventing the cable 4 from separating from the electrical contacts 6. The pair of latches 310 of the cover 3 respectively latches with the first and the second retaining wedges 260, 262 by stages with the engaging portions 26 of the insulative housing 2 respectively received in the slots 312 of the cover 3 for securing the cover 3 to the insulative housing 2. The conductors 40 of the cable 4 and the insulation displacement portions 64 of the contacts 6 are respectively received in the grooves 300 of the cover 3 (FIG. 5). The pull tab 5 is assembled to the insulative housing 2 along the rear-to-front direction of the housing 2 for disengaging the cable end connector assembly 1 from the complementary connector conveniently. The pair of fastening sections 52 is first rotated 90 degrees to allow the posts 514 thereof to protrude through respective recesses 240 of the protrusions 24. Then the fastening sections 52 return to the original state thereof to permit the free ends 515 of the column sections 512 and the posts 514 to be respectively received in the recesses 240. Each stop section 513 of the pull tab 5 abuts against a rear face of each protrusion 24 for preventing a forward movement of the pull tab 5. Each post 514 also protrudes into a corresponding opening 242 of the protrusion 24 and abuts against a recessed portion of the curved edge 2 of the opening 242 for preventing a rearward movement of the pull tab 5. The ribs 244 of the protrusions 24 also function to prevent the fastening sections 52 of the pull tab 5 from moving forwardly excessively. In addition, before the pull tab 5 is assembled to the housing 2, the pair of fastening sections 52 has a first distance D1 therebetween (FIG. 2). After the pull tab 5 is assembled to the housing 2, the pair of fastening sections 52 has a second distance D2 therebetween (FIG. 7). The first distance D1 is smaller than the second distance D2. Thus, a retentive force is exerted on the pull tab 5 after assembly to keep the pull tab 5 in a right position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly, comprising:

an insulative housing comprising a first wall, a second wall opposite to the first wall, and a pair of protrusions on each of the first and the second walls;

a plurality of electrical contacts received in the insulative housing;

a cable electrically terminated with the electrical contacts; and a pull tab assembled to the insulative housing and comprising a pulling section and a pair of fastening sections each forming a pair of posts respectively engaging with the pair of protrusions of the insulative housing.

2. The cable end connector assembly as claimed in claim 1, wherein each protrusion of the insulative housing defines a recess therein, and wherein each post of the fastening section of the pull tab is received in a corresponding recess.

3. The cable end connector assembly as claimed in claim 2, wherein each protrusion defines an opening communicating with the recess thereof, and wherein the posts of the pull tab respectively protrude into the openings.

4. The cable end connector assembly as claimed in claim 1, wherein each fastening section of the pull tab comprises a pair of spaced branches, and wherein the posts are respectively formed on free ends of the branches.

5. The cable end connector assembly as claimed in claim 4, wherein each branch comprises a column section, and wherein the post extends along a direction perpendicular to a longitudinal axis of the column section.

6. The cable end connector assembly as claimed in claim 5, wherein the column section comprises a stop section protruding outwardly from a periphery of the column section and abutting against a rear face of the protrusion for preventing a movement of the pull tab.

7. The cable end connector assembly as claimed in claim 1, wherein the insulative housing comprises a base and a mating portion extending forwardly from the base, and wherein the mating portion is D-shaped.

8. The cable end connector assembly as claimed in claim 7, wherein the insulative housing comprises a guiding post extending forwardly from one end of the base adapted for engaging with a complementary connector.

9. The cable end connector assembly as claimed in claim 7, wherein the insulative housing comprises a pair of engaging portions extending outwardly from opposite ends of the base, and wherein the cover comprises a pair of latches extending forwardly therefrom to respectively engage with the pair of engaging portions of the insulative housing.

10. The cable end connector assembly as claimed in claim 1, wherein the insulative housing comprises a mating face and a termination face opposite to the mating face, and wherein the insulative housing defines a plurality of passageways extending from the termination face toward the mating face to receive the electrical contacts.

11. The cable end connector assembly as claimed in claim 10, wherein each electrical contact comprises a contacting portion received in a corresponding passageway of the insulative housing and an insulation displacement portion extending oppositely from the contacting portion and exposed beyond the termination face of the insulative housing to electrically connected with the cable.

12. The cable end connector assembly as claimed in claim 1, further comprising a cover assembled to the insulative housing and securely attaching the cable to the electrical contacts.

13. The cable end connector assembly as claimed in claim 12, wherein the cover forms a pair of latches extending outwardly therefrom, and wherein the insulative housing forms a pair of engaging portions respectively engaging with the pair of latches of the cover.

14. A cable end connector assembly comprising:

an insulative housing defining two opposite end sections thereof along an lengthwise direction thereof;

a plurality of contacts disposed in the housing;

a flat cable engaged with the contacts;

an insulative cover cooperating with the housing to sandwich the flat cable therebetween;

a pull tab located above the cover and defining a pair of bifurcate fastening sections at two opposite ends thereof respectively latchably engaged with said two opposite end sections, each of said fastening sections including a pair of spaced branches commonly straddling above the cover while respectively received in a corresponding pair of openings in the housing; wherein said pair of openings are located in opposite sides of the housing along a lateral direction perpendicular to said lengthwise direction.

15. The cable end connector assembly as claimed in claim 14, wherein said pull tab is assembled to the housing in a preloaded manner, thereby resulting in opposite inward forces against the housing in said lengthwise direction wherein said opposite inward forces are compliant with forces generated by upwardly pulling the pull tab away from the cover.

16. The cable end connector assembly as claimed in claim 15, wherein said cover is essentially segregated from all of said forces.

17. A cable end connector assembly comprising:

an insulative housing having two opposite end sections;

a plurality of contacts disposed in the housing;

a flat cable engaged with the contacts;

an insulative cover cooperating with the housing to sandwich the flat cable therebetween;

a pull tab located above the cover and defining a pair of fastening sections at two opposite ends thereof respectively latchably engaged with said two opposite end sections, each of said fastening sections including at least a tip post received in a corresponding opening in the housing;

said housing further including a recess in communication with the opening and facing toward the pull tab; wherein the tip post is initially rotated to be compliantly oriented with the recess for insertion and successively rotatably resumes to a original radial position for reception in the opening while avoiding withdrawal from the recess.

18. The cable end connector assembly as claimed in claim 17, wherein said pull tab is assembled to the housing in a preloaded manner, thereby resulting in opposite inward forces against the housing in said lengthwise direction wherein said opposite inward forces are compliant with forces generated by upwardly pulling the pull tab away from the cover.

* * * * *